United States Patent [19]

Coutts

[11] Patent Number: 4,457,131

[45] Date of Patent: Jul. 3, 1984

[54] ASSEMBLY METHOD FOR CABLE-TYPE TIRE CHAINS AND THE LIKE

[75] Inventor: James W. Coutts, Swanton, Vt.

[73] Assignee: Burns Bros., Inc., Portland, Oreg.

[21] Appl. No.: 481,884

[22] Filed: Apr. 4, 1983

Related U.S. Application Data

[62] Division of Ser. No. 259,892, May 1, 1981, Pat. No. 4,396,184.

[51] Int. Cl.[3] ..... B21L 3/00

[52] U.S. Cl. ..... 59/35.1; 269/909; 269/41; 29/464

[58] Field of Search ..... 269/909, 41, 254 CS; 152/222; 59/35.1; 29/464

[56] References Cited

U.S. PATENT DOCUMENTS 1,209,705 12/1916 Hayward ..... 144/2 Q 4,014,534 3/1977 Dwinell ..... 152/222

4,263,954 4/1981 Ahlquist ..... 269/909

*Primary Examiner*—Daniel C. Crane

*Assistant Examiner*—David B. Jones

*Attorney, Agent, or Firm*—Shapiro and Shapiro

[57] ABSTRACT

In the manufacture of a cable-type tire chain having elongate flexible side members and cross-members carrying traction sleeves, the cross-members are connected to the side members by hooks which are crimped to the side members in a press. To assemble the cross members and side members, they are supported in an assembly jig, with the hooks attached to the opposite ends of the cross-members and embracing the side members. The hooks on one side of the chain are crimped simultaneously to the relevant side member in a single pressing operation while supported in the jig, which applies tension to the side member.

1 Claim, 3 Drawing Figures

FIG. 1.
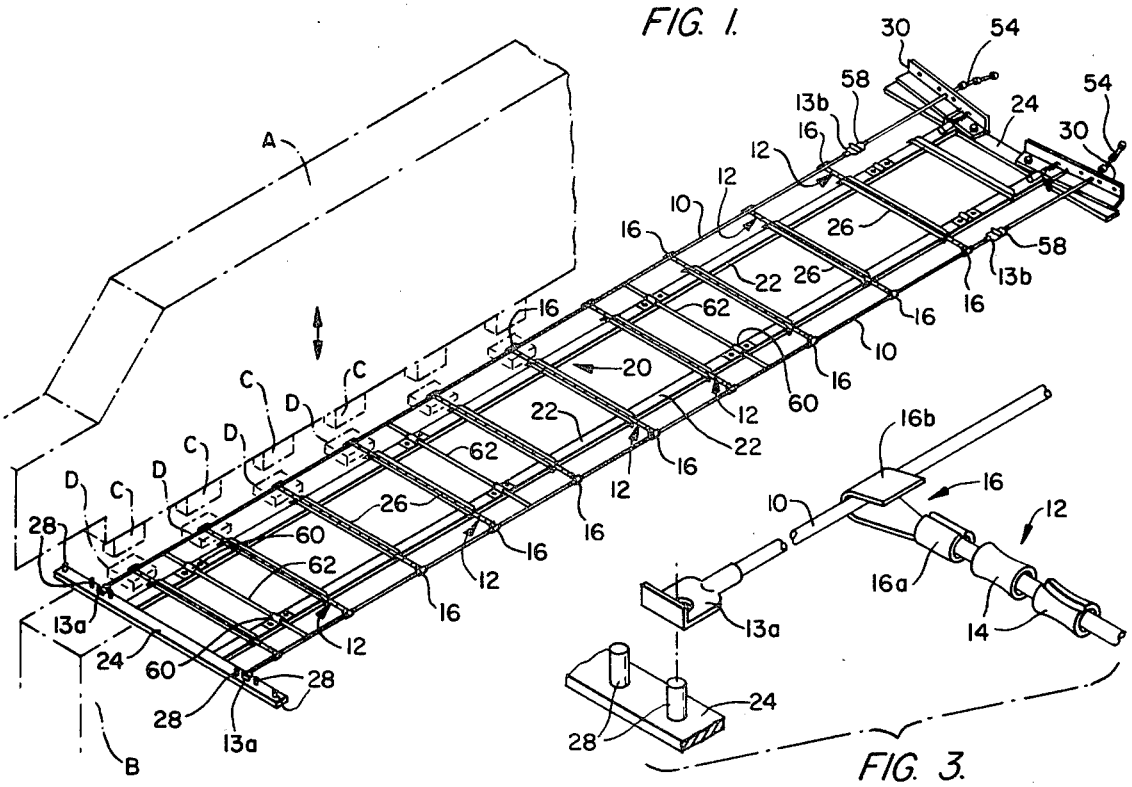
FIG. 3.
FIG. 2.
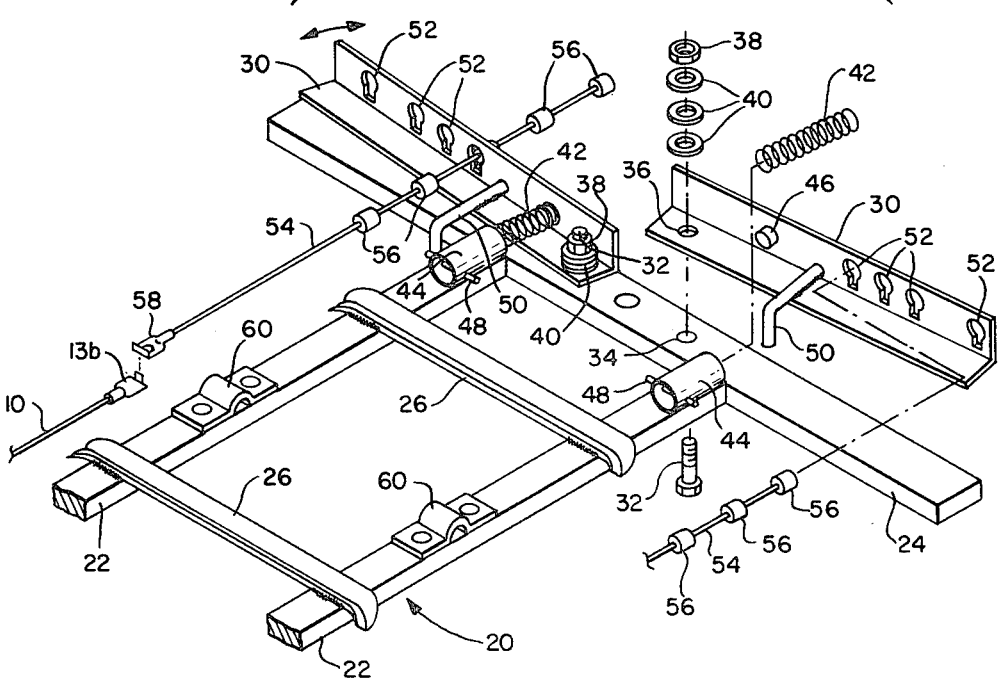

ASSEMBLY METHOD FOR CABLE-TYPE TIRE CHAINS AND THE LIKE

This is a divisional application of Ser. No. 259,892, filed May 1, 1981 now U.S. Pat. No. 4,396,184.

BACKGROUND OF THE INVENTION

This invention relates to a method of assembling cable-type tire chains and the like, and apparatus for use therein.

Cable-type tire chains, for use on vehicle tires to improve traction in poor weather conditions, such as ice or snow, are well known. Such chains may comprise spaced parallel side members, commonly of cable or like elongate flexible material, and cross-members generally of metal cable, which carry traction sleeves and which are connected between the side members. In use, the chain is secured over a tire with the side members extending circumferentially around the opposite side walls of the tire, the cross members extending over and across the tire tread and with the opposite ends of the side members being connected together so that the chain securely embraces the tire.

In order to secure the cross-members to the side members, use may, for example, be made of hooks or the like, which may be crimped or otherwise secured on the ends of the cross-members, and such hooks may, for example, each have a bent-over section for crimping to a side member (see, for example, co-pending U.S. Patent application Ser. No. 071,495 to Dwinell, filed Aug. 31, 1979, now U.S. Pat. No. 4,263,954 and commonly assigned herewith). It is convenient in the manufacture of a cable chain, first, to fully assemble the individual cross-members including securing the hooks thereto, and then to crimp each hook to the respective side member in a pressing operation using suitable pressing dies. The present invention is directed inter alia towards providing a method of assembling tire chain cross-members to the respective side members and apparatus for use in performing the method.

SUMMARY OF THE INVENTION

In one of its aspects, the invention provides a method of assembling a plurality of cross-members to an elongate flexible side member, in the manufacture of a cable-type tire chain or the like wherein each cross-member is provided with a fastener such as a hook adapted to be firmly connected to the side member by a pressing operation, the method including supporting the side member and cross-members in required mutual positions with the fasteners being correctly maintained in position for pressing into connection with the side member, applying tension to the side member, and performing the required pressing operations to firmly connect the fasteners to the side member simultaneously.

The method may, for example, be effected in a press having a plurality of spaced cooperating dies, positioned to operate simultaneously on the cross-member fasteners along one entire side of a tire cable chain. Thus, the assembly of the cross-members and side members of the chain may be performed in only two press operations.

In another of its aspects, the invention provides an assembly jig for use in the manufacture of a cable-type tire chain and the like, for supporting a plurality of spaced cross-members having fasteners at their opposite ends, and a pair of spaced elongate flexible side members in correct mutual positions for connecting the side members to the cross-member fasteners by pressing operations, the jig comprising an elongate frame having a plurality of spaced laterally extending supports for receiving the respective cross-members, means for supporting the side members with the side members extending longitudinally of the frame in engagement with opposite ends of the cross-members, respectively, and means for applying tension to the side members.

The frame may, for example, resemble a ladder in configuration, with the laterally extending supports being in the form of shallow troughs adapted to receive the cross-members, and the frame having laterally projecting transverse members at its opposite ends, between which the side members may be attached. One of the transverse members may include sprung arms which apply longitudinal tension to the side members. The frame may also be provided with transverse rods for maintaining the correct spacing between the side members to ensure that the cross-member fasteners are retained in engagement with the side members. In this respect, the rods may maintain the side members at a spacing whereby a degree of tension is applied to the cross-members.

The invention may be more readily understood with reference to the ensuing description and claims taken in conjunction with the accompanying drawings.

BRIEF DESCRIPTION OF THE DRAWINGS

FIG. 1 is a perspective view illustrating the manner in which an assembly jig, in accordance with the invention, may be used in the manufacture of a cable-type tire chain;

FIG. 2 is an enlarged partly exploded perspective view of one end portion of the assembly jig; and FIG. 3 is a perspective view showing parts of a cross-member, a side member, and the jig.

DESCRIPTION OF THE PREFERRED EMBODIMENT

As shown in FIGS. 1 and 3, a cable-type tire chain, for example of the kind disclosed in the aforementioned patent application, may comprise a pair of elongate flexible side members, such as cables 10, adapted to extend circumferentially around opposite side walls of a tire on which the chain is to be used, and cross-members 12 connected between the side members so as to extend, in use, over and across the tire tread. The cross-members carry traction sleeves 14 and the opposite ends of the side members are provided with suitable connectors 13*a*, 13*b*, which as shown, may be of a known hook and eye type, so that in use the chain may be positioned around the tire and its opposite ends connected together.

The present invention is particularly concerned with the assembly of the cross-members 12 to the side members 10. To this end, each cross-member may carry a fastener in the form of a hook 16 at each end, the hook having a cylindrical portion 16*a* by which it is securely crimped to the cross-member and a hook portion 16*b* to be firmly crimped to one of the side members (see FIG. 3). (It is convenient in the chain manufacture, first to fully assemble each cross-member and then to secure the assembled cross-members to the side members.) Crimping of the hook portions 16*b* to the side members may, for example, be effected in a pressing operation using suitably shaped male and female dies.

In accordance with the invention, the side members and cross members are supported for mutual assembly in a jig, in the form of an elongate frame 20 resembling a ladder in configuration and which may be fabricated, for example, from metal bar stock. Frame 20 includes longitudinal members 22 and transverse members 24 attached to the opposite ends of members 22, for example by welding. Transverse members 24 extend laterally beyond members 22 on each side of the frame. Lateral supports for the chain cross-members, in the form of shallow elongate troughs 26 are connected, e.g. by welding, to the members 22 at spacings corresponding to the required cross-member spacing of the tire chain.

One of the transverse members 24 is provided with attachment means for one end of each of the respective side members, the attachment means, for example, being in the form of lugs 28 to any one of which a connector 13*a* at one end of a side member can be secured. (Alternative forms of attachment means 28 can be used to suit the particular form of side member connectors 13*a* or 13*b*.)

The other transverse cross-member 24 carries a pair of sprung pivotal arms 30, which may be in the form of angle-iron sections, as best seen in FIG. 2, the arms being adapted to apply longitudinal tension to the side members 10 when these are mounted in the jig. Arms 30 may be pivotally mounted on the transverse member by means of screws 32 fitting in aligned openings 34, 36 in the transverse member and arms respectively, the arms being secured by nuts 38 and washers 40. Coil springs 42, fit in bushings 44 attached to frame members 22 and urge the arms 30 longitudinally outwardly with respect to members 24. The springs locate on projections 46 on arms 30, and bushings 44 have locating pins 48 for the springs. Outward movement of arms 30 under the influence of the springs is limited by stops, which may be in the form of bent rods 50 attached to the arms 30, and which are adapted to engage the inner edge of member 24.

Laterally outwardly of the stops 50, each arm 30 has a row of keyhole-like openings 52 corresponding in lateral positioning to the positioning of the attachment means 28 on the other transverse member 24. Each arm 30 may be provided with a connector member 54 comprising, for example, a length of cable, with spaced collars 56 immovably secured thereon, and a connector 58 at one end. The size of the collars 56 is such that they may fit through the larger parts of openings 52 but not through the smaller parts of these openings. Connectors 58 may be of any suitable type adapted to connect with connectors 13*b* at the ends of the cable chain side members. The lateral spacing between openings 52 and between attachment means 28 is such that the cable chain side members may be held in the jig at spacings corresponding to the length of cross-members for different width chains.

Longitudinal frame members 22 may be provided with brackets 60 adapted to receive transverse rods 62 with grooved ends (not shown) for engaging the respective side members.

In use, rods 62 of a length suited to the width of chain being assembled, may be inserted in brackets 60, and the connector members 54 located in the relevant openings 52 to suit the width of the chain. The side members may be connected between attachment means 28 and connectors 58, and the effective lengths of connector members 54 may be adjusted (by engagement of the appropriate collars 56 in openings 52), so that tension is applied longitudinally to the side members by arms 30.

Cross-members 12 are placed in troughs 26, so that hook portions 16*b* embrace the side members 10, as shown in FIG. 3. The spacing of the side members and the applied tension should be sufficient to ensure that the hooks are maintained in embracing relationship with the side members, preferably with a degree of tension being applied to the cross-members. The end grooves of rods 62 may be engaged with the side members 10 so as to support the side members laterally and maintain the required spacing therebetween to ensure sufficient tension on the cross members to maintain the hooks in position. The cross-members may then be assembled to the side members by a pressing operation, which flattens hook portions 16*b* into tightly crimped engagement with the cross-members.

Use of an assembly jig in accordance with the invention allows a plurality of cross-members to be secured to a side member in a single pressing operation, as diagrammatically illustrated in FIG. 1. A conventional form of press, having platens A and B, may be provided with a plurality of male and female dies C and D on the respective platens for crimping hooks 16, the dies being spaced in conformity with the spacing of cross-members 12. Preferably, the number of dies is such that all the hooks on one side member of the cable chain can be pressed in a single operation, and the complete chain can thereby be pressed in only two pressing operations. The jig 20 may, for example, be presented to the press on a suitable movable carriage, which may be reversed between pressing operations to present the respective side members to the press dies.

It is found that use of the inventive method and apparatus, by maintaining the cross member fasteners in correct positions with respect to a side member, through the application of tension, results in accurately formed connections and minimizes the number of assembly operations necessary in manufacturing a tire chain.

While only a single preferred embodiment of the invention has been described herein in detail, the invention is not limited thereby and modifications may be made within the scope of the attached claims.

What is claimed is:

1. In the manufacture of a cable-type tire chain and the like, a method of assembling a plurality of flexible cable cross members to a pair of elongate flexible cable side members by means of hooks attached to the opposite ends of each cross member, said method comprising supporting the side members spaced apart and positioning the cross members spaced apart in succession between the side members transversely thereto, the positioning of the cross members comprising placing each cross member in only a single trough extending transversely of the side members in the space therebetween and with each end of each trough adjacent to and spaced from a corresponding side member, engaging a hook at each end of each cross member with a corresponding side member so that the hooks embrace the corresponding side members, applying tension to the side members, applying sufficient tension to the cross members to retain the hooks embraced with the corresponding side members, the applying of tension to the cross members comprising positioning rod means between the side members with opposite ends of the rod means engaging the respective side members and urging them apart, and closing the hooks upon the corresponding side members by pressing operations, said pressing operations being conducted so that plural hooks embracing one side member are closed simultaneously and plural hooks embracing the remaining side member are closed simultaneously, the hooks being open until said pressing operations.

* * * * *